US005303564A

United States Patent [19]

Britt

[11] Patent Number: 5,303,564

[45] Date of Patent: Apr. 19, 1994

[54] REFRIGERANT RECOVERY AND PURGE APPARATUS

[75] Inventor: Michael L. Britt, Christmas, Fla.

[73] Assignee: Southeastern Refrigerant Management, Inc., Jacksonville, Fla.

[21] Appl. No.: 8,772

[22] Filed: Jan. 25, 1993

[51] Int. Cl.[5] ..... F25B 43/04

[52] U.S. Cl. ..... 62/475; 62/292

[58] Field of Search ..... 62/475, 195, 149, 292, 62/77, 85

[56] References Cited

U.S. PATENT DOCUMENTS 4,304,102 12/1981 Gray ..... 62/475

5,187,953 2/1993 Mount ..... 62/475

*Primary Examiner*—John Sollecito

*Attorney, Agent, or Firm*—Thomas C. Saitta

[57] ABSTRACT

An apparatus is disclosed for the recovery, separation and recycling of refrigerant from a number of refrigerant chiller systems having individual low efficiency purgers. The apparatus has a high efficiency purger which reduces refrigerant contaminants in the non-condensable gases vented to atmosphere by 90 percent over that of the low efficiency purgers, and operates without interference with the normal purging cycles of the chillers. The apparatus further comprises conduits, valves and a pump which enables the apparatus to completely evacuate the refrigerant gas and refrigerant liquid from the chiller systems.

19 Claims, 2 Drawing Sheets

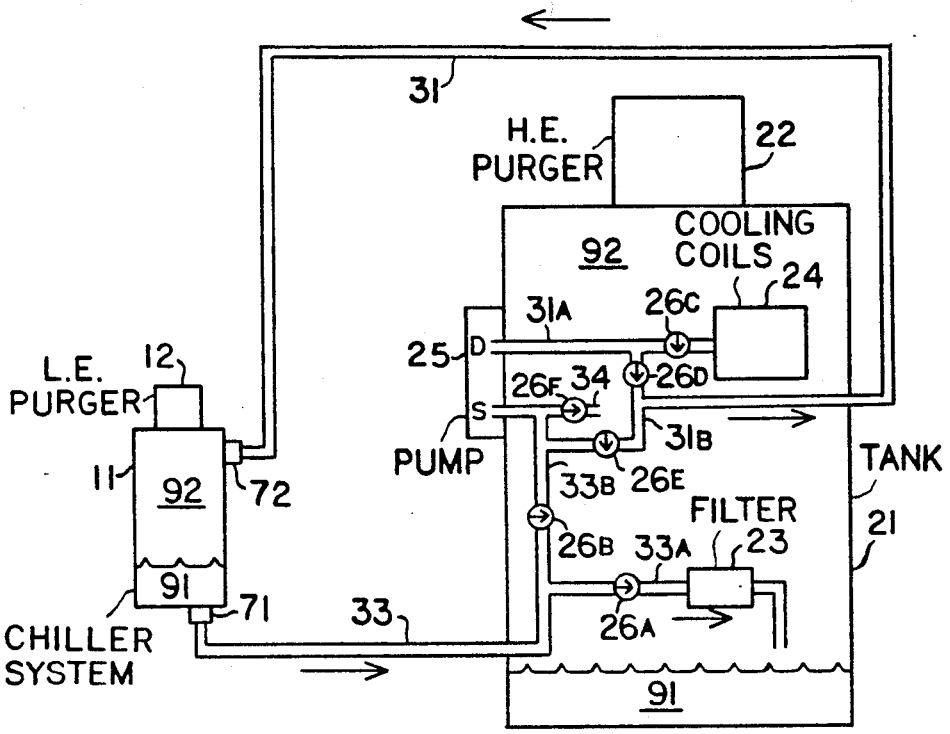
FIG. 3
FIG. 4
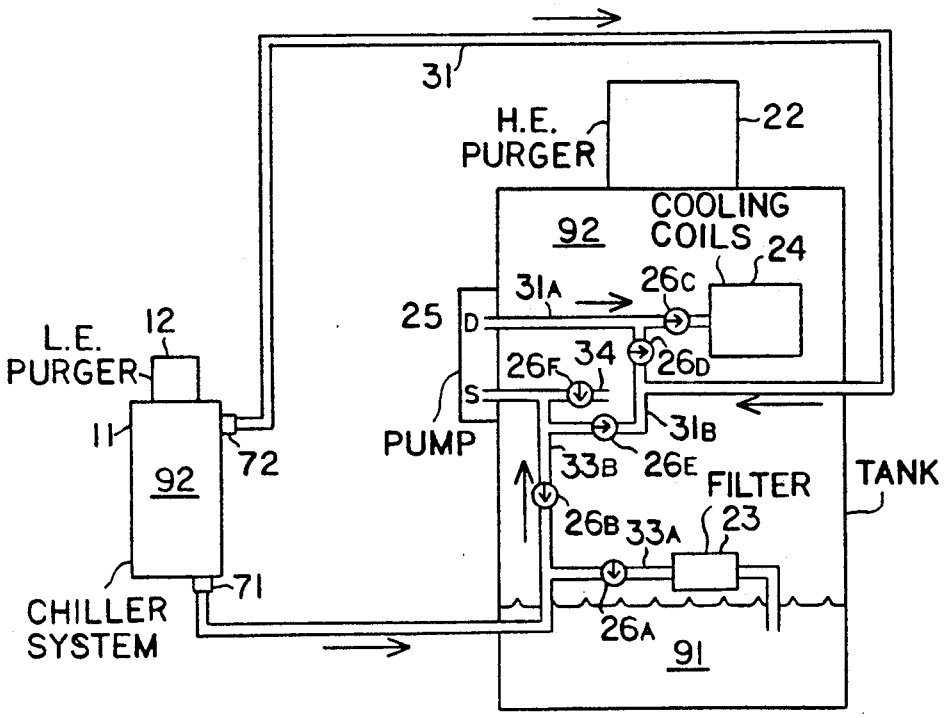

REFRIGERANT RECOVERY AND PURGE APPARATUS

BACKGROUND OF THE INVENTION

This invention relates generally to a refrigerant recovery apparatus used for removing, purifying and recycling refrigerant from refrigerant systems. More particularly, the invention relates to such an apparatus adapted for use with refrigerant systems commonly known as chillers, which operate at negative pressure, such that when leaks occur non-condensable atmospheric gases are drawn into the system, the non-condensable gases reducing the efficiency of the chillers to the point that the non-condensable gases must be separated from the refrigerant gases by a purger system. Even more particularly, the invention relates to an apparatus incorporating a recovery tank coupled with a slow, high efficiency purger to further separate the refrigerant gases from the non-condensable gases after initial treatment by fast, low efficiency purger systems, capable of receiving gases from a plural number of refrigerant chiller systems, as well as capable of withdrawing both liquid refrigerant and refrigerant gas from the refrigerant chiller systems.

Refrigerant chiller systems comprising a system for utilizing compressible refrigerant gases, for example CFC, to remove heat from the air, are well known for use in large buildings. For any relatively large building, a number of individual refrigerant chillers will be needed. The chiller systems operate at below atmospheric pressure, so that any leaks occurring in the system result in non-condensable atmospheric air being drawn into the system. This reduces the efficiency of the system and will eventually prevent the chiller systems from performing their function, unless the non-condensable gases are periodically removed from the system. It is known to use purger systems permanently connected to the chillers to separate the refrigerant gas from the non-condensable gases, the refrigerant gas undergoing a phase change into the liquid form in the presence of cooling coils contained within the purger. The non-condensable gases remaining in the gaseous state are then typically vented to atmosphere. Because of time and cost considerations, the purgers used with chillers are relatively fast, but low efficiency purgers, the cooling coils operating in the 35 to 80 degree Fahrenheit temperature range. This results in the bulk of the refrigerant gas being separated from the non-condensable gases, but the gas vented to atmosphere still contains a relatively large component of harmful refrigerant gas. As the pollution problem grows, stricter emission standards are being implemented, to the point that the standard low efficiency purgers do not remove enough of the refrigerant gases to satisfy the requirements.

There exist high efficiency purgers which operate at temperatures in the area of zero degrees Fahrenheit, but these purgers are slow in operation and relatively costly, to the point that equipping each refrigerant chiller system is not a practical solution to the problem. To prevent the venting of refrigerant gas to the atmosphere along with the non-condensable gases, a refrigerant recovery apparatus has been developed which can be interconnected with any number of refrigerant chiller systems and low efficiency purgers, the refrigerant recovery apparatus having a large capacity recovery tank containing cooling coils for initial separation and a slow, but high efficiency purger to dramatically reduce the amount of residual refrigerant gas mixed with the non-condensable gases prior to venting to atmosphere.

It is an object of this invention to provide a refrigerant recovery apparatus with a slow, high efficiency purger, which can be utilized with any number of refrigerant chiller systems having fast, low efficiency purgers, to separate the harmful refrigerant gas from the non-condensable gases prior to venting to atmosphere.

It is a further object of the invention to provide such an apparatus that takes the output gas from the low efficiency purgers and further purifies it by separating out up to 90 percent of the refrigerant gas remaining in the output gas prior to venting to atmosphere.

It is a further object of the invention to provide such a apparatus that operates automatically and does not interfere with the normal purging cycles of the individual refrigerant chiller systems.

It is a further object to provide such a system which allows also remove and replace liquid refrigerant and refrigerant gas the recovered refrigerant, now in liquid form, to be recycled back into the refrigerant chiller systems.

It is a further object to provide such a system which can directly from the refrigerant chiller systems.

SUMMARY OF THE INVENTION

The invention is an apparatus for the purging, purification, recovery and recycling of refrigerant adapted for use with one or more refrigerant chiller systems which are coupled with fast, low efficiency purgers for separating non-condensable gases from the condensable refrigerant gas. The invention comprises a recovery tank containing cooling coils for condensing refrigerant gas in the known manner, coupled with a slow, high efficiency purger for further separating the refrigerant gas from the non-condensable gases, conduit means connecting said recovery tank to said one or more refrigerant systems for transport of either liquid refrigerant or gas refrigerant from the refrigerant systems, conduit means connecting said recovery tank to said fast, low efficiency purgers for transport of the non-condensable gases from said low efficiency purgers, and pumping means for effecting transfer of the gases and liquid.

Non-condensable gases, which still contain small amounts of refrigerant gas even after initial purging, are transferred from the fast, low efficiency purgers into the recovery tank, allowing the slow, high efficiency purger on the recovery tank to more effectively separate the refrigerant gas from the non-condensable gases, such that the non-condensable gases eventually vented to atmosphere are highly purified with only extremely small amounts of refrigerant gas contamination. The recovered refrigerant, now in liquid form, can be recycled back into the refrigerant systems or removed for proper disposal. The capacity of the recovery tank is such that a number of refrigerant systems, each with its own fast, low efficiency purger, can be connected to the invention. The fast, low efficiency purgers can then operate in their usual cycles, separating the bulk of the refrigerant gas from the non-condensable gases, with the non-condensable gases containing small amounts of refrigerant gas being automatically transferred to the recovery tank. When a predetermined pressure is obtained within the recovery tank, the slow, high efficiency purger is activated and the vast bulk of remaining refrigerant gas is separated from the non-condensable gases, which are then safely vented to atmosphere.

The invention also allows for direct removal and replacement of both liquid refrigerant and refrigerant gas from the refrigerant chiller systems, for situations where the refrigerant system needs to be completely evacuated for repair or the like. Complete evacuation of refrigerant is accomplished by pumping gas from the recovery tank into the chiller vapor port, thus creating a low pressure situation in the recovery tank which draws the liquid refrigerant from the chiller liquid port into the recovery tank of the invention, until only gas remains in the chiller system. Then the valving is arranged so that the suction pump of the invention pulls gas from both the chiller vapor port and the chiller liquid port and into the cooling coils of the recovery tank, thus reducing the pressure within the tank due to the condensation of gas to liquid refrigerant so that the chiller system can be completely evacuated. The high efficiency purger of the invention removes any non-condensables prior to return of the refrigerant to the chiller system.

BRIEF DESCRIPTION OF THE DRAWINGS

FIG. 3 is a schematic showing the flowpath of liquid refrigerant during removal from a refrigerant chiller system.

FIG. 4 is a schematic showing the flowpath of refrigerant gases during removal from a refrigerant chiller system.

DETAILED DESCRIPTION OF THE INVENTION

The invention is a refrigerant recovery apparatus adapted for use with standard refrigerant chiller systems having purgers for removal of gas refrigerant from non-condensable gases prior to venting of the gases to atmosphere. Refrigerant chiller systems are used, for example, to air condition buildings, and use compressible CFC or similar substances which undergo suitable phase changes from liquid to gas. These refrigerant systems operate at negative pressure, such that any leakage in the system results in the suction of non-condensable atmospheric gases into the system. To separate the non-condensable gases from the refrigerant, it is known to utilize purger apparati which contain cooling coils to change the refrigerant from the gas to the liquid form. These cooling coils operate at temperatures ranging from 35 to 80 degrees Fahrenheit and liquify the large majority of refrigerant gas, but a significantly large amount of refrigerant gas, in regard to the potential hazards of atmospheric pollution, remain mixed with the non-condensable gases. It has been standard practice to vent these gases to atmosphere, but ne regulations require that the purged gases contain significantly less contaminants than can be removed by the fast, but low efficient purgers currently in use.

Figure 1:
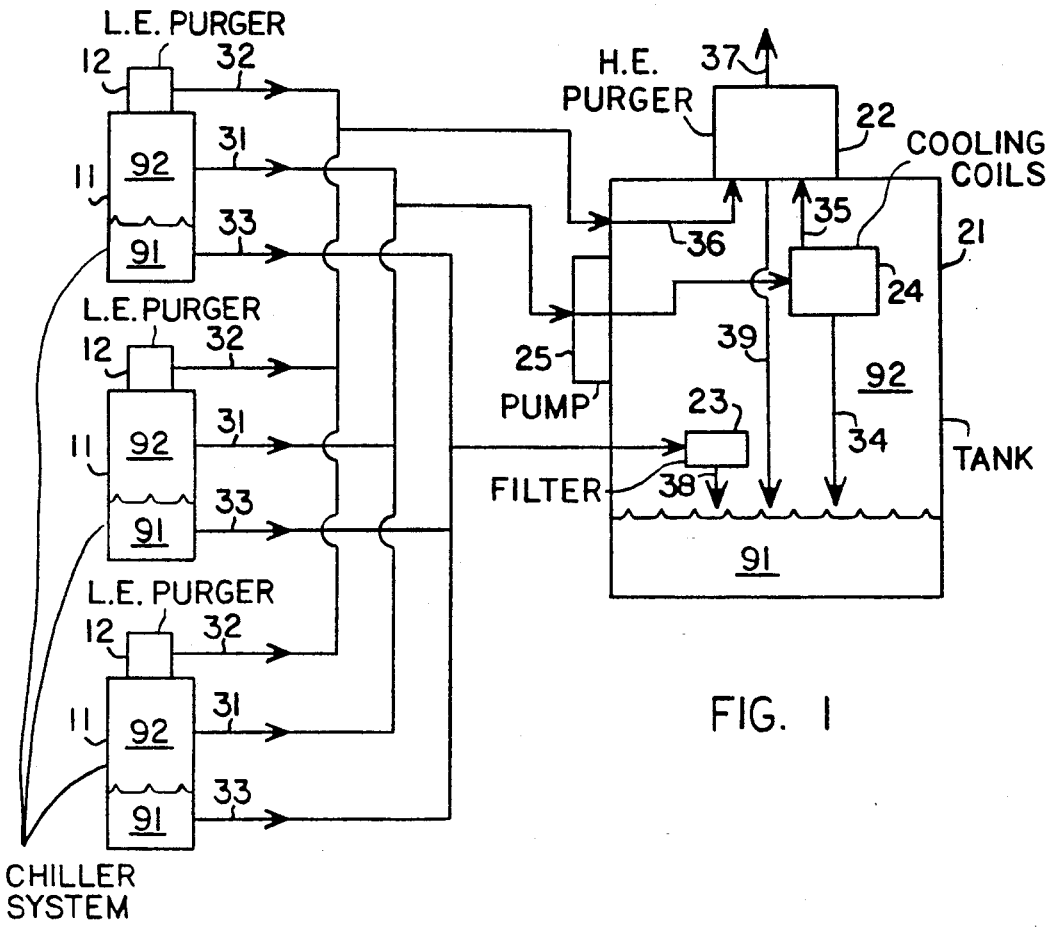
FIG. 1 is a schematic showing the invention as connected to three refrigerant chiller systems.

With reference now to Figure 1, the invention is illustrated in relation to a plurality of standard refrigerant chiller systems 11. A large building may have a number of individual chillers 11, each with their own fast, low efficiency purgers 12. The invention comprises a relatively large recovery tank 21, which is constructed of suitable materials to withstand high internal pressures. The particular size of the recovery tank 21 is a function of the size and number of chiller systems 11 to which it is connected. The invention further comprises a slow, high efficiency purger apparatus 22 connected to the recovery tank 21 such that gases within the tank are passed through the high efficiency purger 22 and vented to atmosphere after separation of the refrigerant contaminant from the non-condensable gases. High efficiency purgers 22 are known in the art and, similar to low efficiency purgers 12, use cooling coils to separate the refrigerant gas 92 from the non-condensable atmospheric gases by inducing a phase change to liquid refrigerant 91. High efficiency purgers 22 are up to 90 percent more effective in this operation than low efficiency purgers because the cooling coils operate at roughly 0 degrees Fahrenheit. However, high efficiency purgers 22 are both slower and much more costly than low efficiency purgers 12, since the low efficiency purgers 12 are cooled using available chilled water or the like. It is therefore not a suitable solution to reduce refrigerant contamination of non-condensable gases vented to atmosphere by simply replacing low efficiency purgers 12 with high efficiency purgers 22.

The recovery tank 21 further comprises standard cooling coils 24 and a standard filter 23 for the liquid refrigerant 92. Transfer of refrigerant gas 92 and liquid 91 is accomplished by pumping means 25. Through suitable conduits and valving refrigerant gas 92 is withdrawn directly from the chiller system 11, illustrated by conduit flowpath 31. Additionally, the pumping means 25 can be adapted to indirectly suction liquid refrigerant 91 from the chiller system 11, as illustrated by conduit flowpath 33. Liquid refrigerant 91 is taken via conduit 33 to filter 23 and collects in the bottom of recovery tank 21, as shown by flowpath 38. Gas refrigerant 92, along with any non-condensables mixed therewith, is taken via conduit 31 through the pumping means 25 and directed onto the cooling coils 24 to separate the majority of the refrigerant from the non-condensable gases by changing the refrigerant into the liquid form, where it collects in the bottom of recovery tank 21 as shown by flowpath 34. The non-condensable gases containing minor amounts of refrigerant gas 92 are then passed through the high efficiency purger 22, as shown by flowpath 35, where the remaining refrigerant is separated by converting it to liquid form, as shown by flowpath 39, and the non-condensable gases are then safely vented to atmosphere, as shown by flowpath 37. Non-condensable gases containing refrigerant contaminant are transferred from the low efficiency purger 12 via conduit flowpath 32 directly into recovery tank 21, where the gases are passed through high efficiency purger 22, as shown by flowpath 36, and the liquid refrigerant 91 is separated from the non-condensables, the liquid refrigerant 91 settling in the recover tank 21 as shown by flowpath 39 and the non-condensable gases being vented to atmosphere as shown by flowpath 37.

Figure 2:
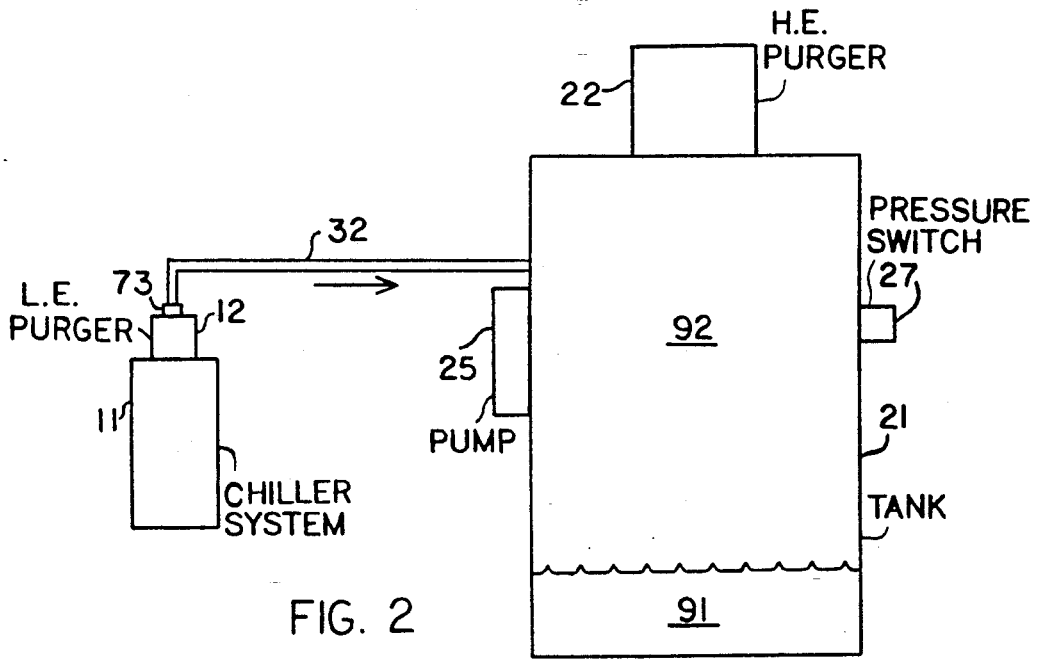
FIG. 2 is a schematic showing the flowpath during transfer of gases from the output port of a fast, low efficient purger on a refrigerant chiller system.

With reference now to FIG. 2, the components of the invention are shown with reference to the transfer operation of recovering contaminated purged non-condensable gases from the low efficiency purger 12 of a standard refrigerant chiller system 11. Valved conduit means 32 connects the vent port 73 of the low efficiency purge 12 directly to the interior of recovery tank 21. Gas outputs from a number of purging cycles of the low efficiency purgers 12 are collected in the recovery tank 21 until a build-up of internal pressure initiates a pressure switch 27, activating the high efficiency purger 22. For example, the activation switch may be set to initiate purging operations at a pressure of approximately 7 psig, and set to stop purging operations after a suitable drop in internal pressure. The refrigerant contaminants remaining mixed with the non condensable gases from the low efficiency purger 12 are now removed by the phase change to liquid form, such that the liquid refrigerant 91 settles to the bottom of the recovery tank 21 and the non-condensable gases are vented to atmosphere from the high efficiency purger 22. The process is automatic, with any number of low efficiency purgers 12 discharging gases into the recovery tank 21 at any frequency, thus allowing the individual chiller systems 11 to operate without interruption. The large capacity of the recovery tank (for example, 2000 to 5000 pounds) allows for acceptance of the output gases from a number of low efficiency purgers 12 even though the purging action of the high efficiency purger 22 is relatively slow. The recovered liquid refrigerant 91 can be recycled to the chiller systems 11 or removed from the recovery tank 21 for disposal.

The invention further comprises a system of conduit means and valving which allow for the creation of distinct flowpaths in order to completely evacuate refrigerant from a chiller system 11. As seen in FIGS. 3 and 4, the process involves first removing liquid refrigerant 91 from the chiller system 11 and then removing refrigerant gas 92 from the chiller system 11, after resetting various valves 26. With reference now to FIG. 3, the recovery of liquid refrigerant 91 is shown. Liquid refrigerant conduit 3 is connected between the chiller liquid port 91 of the chiller 11 and the components of recovery tank 21. Conduit 33 branches, with one conduit branch 33*a* connecting to the filter 23 and the other conduit branch 33*b* connecting to the suction side of the pumping means 25. Valve 26*a* opens and closes conduit 33*a*, and valve 26*b* opens and closes conduit 33*b*. A branched gas conduit 31*a* connects the discharge side of the pumping means 25 to the cooling coils, controlled by valve 26*c*, and gas refrigerant conduit 31, controlled by valve 26*d*, which connects to the chiller vapor port 72 of chiller 11. Conduits 31*a* and 31 are also connected to the suction side of pumping means 25 by conduit 31*b* and controlled by valve 26*e*. Additionally, the suction side of pumping means 25 is connected directly to the interior of recovery tank 21 by conduit 34, controlled by valve 26*f*.

To remove liquid refrigerant from chiller 11, valves 26*a*, 26*d* and 26*f*, are opened and valves 26*b*, 26*c* and 26*e* are closed. Pumping means 25, which consists of any of the known pumping devices suitable for transferring gas, is activated. This causes gas refrigerant 92 to be removed from the interior of recovery tank 21 through conduit 34 and valve 26*f*. This refrigerant gas is transferred through conduit 31*a*, valve 26*d* and conduit 31 through the vapor port 72 of chiller 11. This lowers the pressure within recovery tank 21 and increases the pressure within chiller 11, causing the liquid refrigerant 91 in chiller 11 to flow through liquid port 71, conduit 33, valve 26*a*, and conduit 33*a* into filter 23 and then into the bottom of recovery tank 21. Upon removal of all the liquid refrigerant 91 form the chiller 11, the pumping means 25 is deactivated and the valving closed.

Referring now to FIG. 4, the removal of the gas refrigerant 92, plus any non-condensable gases, from chiller 11 is shown. When no liquid refrigerant remains in chiller 11, valves 26*a*, 26*d* and 26*f* are closed and valves 26*b*, 26*c* and 26*e* are opened. Pumping means 25 is activated, resulting in withdrawal of refrigerant gas 92 from chiller 11 through liquid port 71, conduit 33, conduit 33*b*, valve 26*b* and into the suction side of the pumping means 25. At the same time, refrigerant gas 92 from chiller 11 is being withdrawn through vapor port 72, conduit 31, conduit 31*b*, valve 26*e* and into the suction side of pumping means 25. The gas is discharged from pumping means 25 through conduit 31*a* and valve 26*c* onto the cooling coils 24. This results in condensation of the refrigerant gas 92 into the liquid refrigerant 91, which is collected in the recovery tank 21. This phase change from gas to liquid results in a reduction of pressure within the recovery tank 21 to the extent that all refrigerant gases 92 can be removed from chiller 11. As with the direct collection of gases from the low efficiency purgers 12 of chillers 11, the high efficiency purger 22 separates the non-condensable gases from the refrigerant gas 92 which has been directly removed from the chiller systems 11, venting the non-condensable gases to atmosphere and thus purifying the refrigerant contained in the recovery tank 21. Upon completion of repairs to the chiller system 11, the liquid refrigerant 91 may be transferred back into the chiller 11 by reducing the pressure through vapor port 72 using pumping means 25, increasing the pressure within recovery tank 21, and transferring the liquid refrigerant 91 through liquid port 71.

It will be obvious to those skilled in the art that equivalents and substitutions may exist for the elements set forth above, and the above examples are by way of illustration only. The full scope and definition of the invention therefore is to be as set forth in the following claims.

I claim:

1. An apparatus for recovering, separating and recycling of refrigerant and non-condensable gases from one or more refrigerant chiller systems coupled with one or more low efficiency purgers, said apparatus comprising:

(A) a recovery tank to receive and contain refrigerant gas and refrigerant liquid from one or more refrigerant chiller systems, and to further receive and contain non-condensable gases and refrigerant gas from one or more low efficiency purgers;

(B) cooling coils to separate said refrigerant gas from said non-condensable gases in said recovery tank;

(C) a high efficiency purger connected to said recovery tank to further separate said refrigerant gas from said non-condensable gases within said recovery tank;

(D) pumping means to effect the transfer of said refrigerant gas and said refrigerant liquid between said one or more refrigerant chiller systems and said recovery tank;

(E) conduit means connecting said low efficiency purger to said recovery tank for transfer of said non-condensable gases and refrigerant gas;

(F) conduit means connecting said refrigerant chiller system to said recovery tank for transfer of said refrigerant gas;

(G) conduit means connecting said refrigerant chiller system to said recovery tank and to said pumping means for transfer of said refrigerant liquid, whereby said liquid refrigerant can be transferred from said refrigerant chiller system to either said recovery tank directly or through said pumping means; and (H) valves to control the flowpaths of said conduit means.

2. The apparatus of claim 1, where said conduit means for transfer of said refrigerant gas is connected to said recovery tank through said pumping means.

3. The apparatus of claim 2, where said conduit means for transfer of said refrigerant gas further connect said pumping means to said cooling coils.

4. The apparatus of claim 1, where said valves can be set to allow flow in either direction within said conduit means for transfer of said refrigerant gas.

5. The apparatus of claim 1, where said conduit means for transfer of said refrigerant liquid is branched.

6. The apparatus of claim 1, where said high efficiency purger comprises cooling coils operating at approximately 0 degrees Fahrenheit.

7. An apparatus for recovering, separating and recycling of refrigerant and non-condensable gases from one or more refrigerant chiller systems coupled with one or more low efficiency purgers, said apparatus comprising:

(A) a recovery tank to receive and contain refrigerant gas and refrigerant liquid from one or more refrigerant chiller systems, and to further receive and contain non-condensable gases and refrigerant gas from one or more low efficiency purgers;

(B) cooling coils to separate said refrigerant gas from said non-condensable gases in said recovery tank;

(C) a high efficiency purger connected to said recovery tank to further separate said refrigerant gas from said non-condensable gases within said recovery tank;

(D) pumping means to effect the transfer of said refrigerant gas and said refrigerant liquid between said one or more refrigerant chiller systems and said recovery tank, where said pumping means is adapted to transfer said refrigerant gas through both conduit means for transfer of said refrigerant gas and conduit means for transfer of said refrigerant liquid;

(E) conduit means connecting said low efficiency purger to said recovery tank for transfer of said non-condensable gases and refrigerant gas;

(F) conduit means connecting said refrigerant chiller system to said recovery tank for transfer of said refrigerant gas;

(G) conduit means connecting said refrigerant chiller system to said recovery tank for transfer of said refrigerant liquid; and (H) valves to control the flowpaths of said conduit means.

8. The apparatus of claim 7, where said conduit means for transfer of said refrigerant gas is connected to said recovery tank through said pumping means.

9. The apparatus of claim 8, where said conduit means for transfer of said refrigerant gas further connect said pumping means to said cooling coils.

10. The apparatus of claim 7, where said valves can be set to allow flow in either direction within said conduit means for transfer of said refrigerant gas.

11. The apparatus of claim 7, where said conduit means for transfer of said refrigerant liquid is branched and is connected to said recovery tank directly and through said pumping means, where said valves control flow of said refrigerant liquid to said recover tank or to said pumping means.

12. The apparatus of claim 7, where said high efficiency purger comprises cooling coils operating at approximately 0 degrees Fahrenheit.

13. An apparatus for recovering, separating and recycling of refrigerant and non-condensable gases from one or more refrigerant chiller systems coupled with one or more low efficiency purgers, said apparatus comprising:

(A) a recovery tank to receive and contain refrigerant gas and refrigerant liquid from one or more refrigerant chiller systems, and to further receive and contain non-condensable gases and refrigerant gas from one or more low efficiency purgers;

(B) cooling coils to separate said refrigerant gas from said non-condensable gases in said recovery tank;

(C) a high efficiency purger connected to said recovery tank to further separate said refrigerant gas from said non-condensable gases within said recovery tank;

(D) pumping means to effect the transfer of both said refrigerant gas and said refrigerant liquid between said one or more refrigerant chiller systems and said recovery tank, and to transfer said refrigerant gas from said recovery tank to said one or more refrigerant systems;

(E) conduit means connecting said low efficiency purger to said recovery tank for transfer of said non-condensable gases and said refrigerant gas;

(F) conduit means connecting said refrigerant chiller system to said recovery tank for transfer of said refrigerant gas;

(G) conduit means connecting said refrigerant chiller system to said recovery tank for transfer of said refrigerant liquid; and (H) valves to control the flowpaths of said conduit means.

14. The apparatus of claim 13, where said conduit means for transfer of said refrigerant gas is connected to said recovery tank through said pumping means.

15. The apparatus of claim 14, where said conduit means for transfer of said refrigerant gas further connect said pumping means to said cooling coils.

16. The apparatus of claim 13, where said valves can be set to allow flow in either direction within said conduit means for transfer of said refrigerant gas.

17. The apparatus of claim 13, where said conduit means for transfer of said refrigerant liquid is branched and is connected to said recovery tank directly and through said pumping means, where said valves control flow of said refrigerant liquid to said recovery tank or to said pumping means.

18. The apparatus of claim 13, where said high efficiency purger comprises cooling coils operating at approximately 0 degrees Fahrenheit.

19. The apparatus of claim 13, where said pumping means is adapted to transfer said refrigerant gas through both said conduit means for transfer of said refrigerant gas and said conduit means for transfer of said refrigerant liquid.

* * * * *